US008756882B1

(12) United States Patent
Vachon

(10) Patent No.: US 8,756,882 B1
(45) Date of Patent: Jun. 24, 2014

(54) TILE FOR USE IN A MODULAR FLOORING SYSTEM

(71) Applicant: Le Groupe DSD Inc., Thetford Mines (CA)

(72) Inventor: Leandre Vachon, Thetford Mines (CA)

(73) Assignee: Le Groupe DSD Inc., Thetford Mines, Quebec (CA)

( * ) Notice: Subject to any disclaimer, the term of this patent is extended or adjusted under 35 U.S.C. 154(b) by 0 days.

(21) Appl. No.: 14/068,775

(22) Filed: Oct. 31, 2013

(51) Int. Cl.
*E04F 15/10* (2006.01)

(52) U.S. Cl.
USPC ..... 52/180; 52/177; 52/591.1

(58) Field of Classification Search
CPC ..... E04F 2201/00; E04F 2201/01; E04F 2201/0138; E04F 2201/0146; E04F 15/10; E04F 15/16
USPC ..... 52/177, 180, 382.2, 384, 386, 387, 390, 52/392, 589.1, 591.1, 591.2, 591.3, 582.2; 403/364, 345; 404/35, 40, 41
See application file for complete search history.

(56) References Cited

U.S. PATENT DOCUMENTS

| | | | | |
|---|---|---|---|---|
| 3,946,529 | A | 3/1976 | Chevaux | |
| 4,008,548 | A * | 2/1977 | Leclerc | 52/180 |
| 4,584,221 | A | 4/1986 | Kueng | |
| 4,930,286 | A | 6/1990 | Kotler | |
| 5,509,244 | A * | 4/1996 | Bentzon | 52/387 |
| 5,787,654 | A * | 8/1998 | Drost | 52/177 |
| 5,992,106 | A * | 11/1999 | Carling et al. | 52/177 |
| 6,098,354 | A | 8/2000 | Skandis | |
| 6,751,912 | B2 | 6/2004 | Stegner et al. | |
| D522,067 | S | 5/2006 | Allen | |
| 7,114,298 | B2 | 10/2006 | Kotler | |
| 7,571,572 | B2 * | 8/2009 | Moller, Jr. | 52/177 |
| 7,587,865 | B2 | 9/2009 | Moller, Jr. | |
| 7,748,177 | B2 | 7/2010 | Jenkins et al. | |
| 7,793,471 | B2 | 9/2010 | Hill | |
| 7,918,057 | B2 | 4/2011 | Moller, Jr. | |
| 8,006,443 | B2 | 8/2011 | Fuccella et al. | |
| 8,122,670 | B2 | 2/2012 | Matthee | |
| 8,161,711 | B2 | 4/2012 | Steed | |
| 8,225,566 | B2 * | 7/2012 | Prevost et al. | 52/302.1 |
| 8,266,849 | B2 | 9/2012 | Bravo et al. | |
| 8,397,466 | B2 | 3/2013 | Jenkins et al. | |
| 8,424,257 | B2 | 4/2013 | Jenkins et al. | |
| 2004/0258869 | A1 * | 12/2004 | Walker | 428/44 |
| 2005/0193669 | A1 * | 9/2005 | Jenkins et al. | 52/392 |
| 2005/0252109 | A1 * | 11/2005 | Fuccella et al. | 52/177 |

* cited by examiner

*Primary Examiner* — Brian Glessner
*Assistant Examiner* — Adam Barlow
(74) *Attorney, Agent, or Firm* — IPAXIO S.E.N.C.

(57) ABSTRACT

The tile includes a monolithic support grid structure having a rectangular configuration with four peripheral edges. The support grid structure includes a lattice framework of elongated rib members crisscrossing at right angle on the underside of the support grid structure and defining a network of cells. The support grid structure also includes a plurality of support members, each downwardly projecting from a corresponding intersection between the crisscrossing elongated rib members and having a ground-engaging distal end with a tip that is coincident with a common bottom plane. The tile includes a plurality of tile edge connectors that are positioned on the underside and made integral with the support grid structure.

20 Claims, 9 Drawing Sheets

TILE FOR USE IN A MODULAR FLOORING SYSTEM

TECHNICAL FIELD

The technical field relates generally to tiles for use in modular flooring systems having a plurality of such tiles that are mutually adjoined in abutting lateral contact and that are disposed in a coplanar manner over ground surfaces so as to form continuous floor surfaces.

BACKGROUND

Various arrangements of modular flooring systems having interlocking tiles to create playing surfaces have been suggested in the past. These arrangements generally include modular tiles of plastic composition which are interlocked with one another to form the playing surfaces, for instance for sports or other activities and/or purposes. The modular tiles are disposed on a supporting ground surface such as a concrete floor, asphalt or any other suitable surface.

One of the challenges in the design of sport playing surfaces made of modular tiles is that the tiles must resist the sudden lateral forces imposed during use. These forces can be the result of actions such as jumping, running, changing direction of movement, etc. Depending on the nature of the sports or the activities, tiles can be designed with a resilient construction capable of absorbing some of the forces or with only rigid parts so as to mitigate any relative movement between the tiles when subjected to lateral forces. Tiles that are entirely made of a rigid material are used in sports where the local lateral forces tend to be very high, such as in-line skating. An in-line skating rink for sports such as hockey or the like can impose very high mechanical stresses on the tiles, particularly at their connection points. Tiles having high mechanical resistance requirements must also have a realistic manufacturing cost.

Consequently, several factors have to be taken into account by designers, which in practice is very difficult using the plastic tiles of known modular flooring systems.

Room for improvements always exists in this technical area.

SUMMARY

In one aspect, there is provided a tile for use in a modular flooring system having a plurality of such tile that are mutually adjoined in abutting lateral contact and that are disposed in a coplanar manner over a ground surface so as to form a continuous and flat floor surface, the tile having a planar top surface and an underside, the tile including: a monolithic support grid structure having a rectangular configuration with four peripheral edges, the support grid structure including: a lattice framework of elongated rib members crisscrossing at right angle on the underside of the support grid structure and defining a network of cells; a plurality of support members, each downwardly projecting from a corresponding intersection between at least some of the crisscrossing elongated rib members and having a ground-engaging distal end with a tip that is coincident with a common bottom plane, which common bottom plane is substantially parallel to the planar top surface; and a plurality of tile edge connectors that are positioned on the underside and made integral with the support grid structure, each tile edge connector being removably formed by a first connector portion and by a complementary second connector portion provided on an adjacent one of the tile, the first connector portions and the second connector portions being both present on the tile and disposed in matching sets along corresponding ones of the peripheral edges of the tile, wherein: each first connector portion includes two spaced-apart and parallel side walls downwardly projecting from two corresponding ones of the elongated rib members over at least two cells long, the side walls having free ends extending beyond the corresponding peripheral edge and that are connected together by a transversal end wall, the transversal end wall including an inner face defining, with inner faces of the side walls, an open space located beyond the corresponding peripheral edge; and each second connector portion includes a snap-fit member downwardly projecting from a corresponding one of the cells and also includes a pair of spaced-apart and parallel reinforced wall sections, each section being provided on the underside and downwardly projecting from a corresponding one of the elongated rib members over at least two cells long, each reinforced wall section being in alignment with a corresponding one of the side walls of the first connector portion once the tile edge connector is formed between two adjacent ones of the tile.

Details on the various aspects and features of the proposed concept will be apparent from the following detailed description and the appended figures.

DETAILED DESCRIPTION

Figure 1:
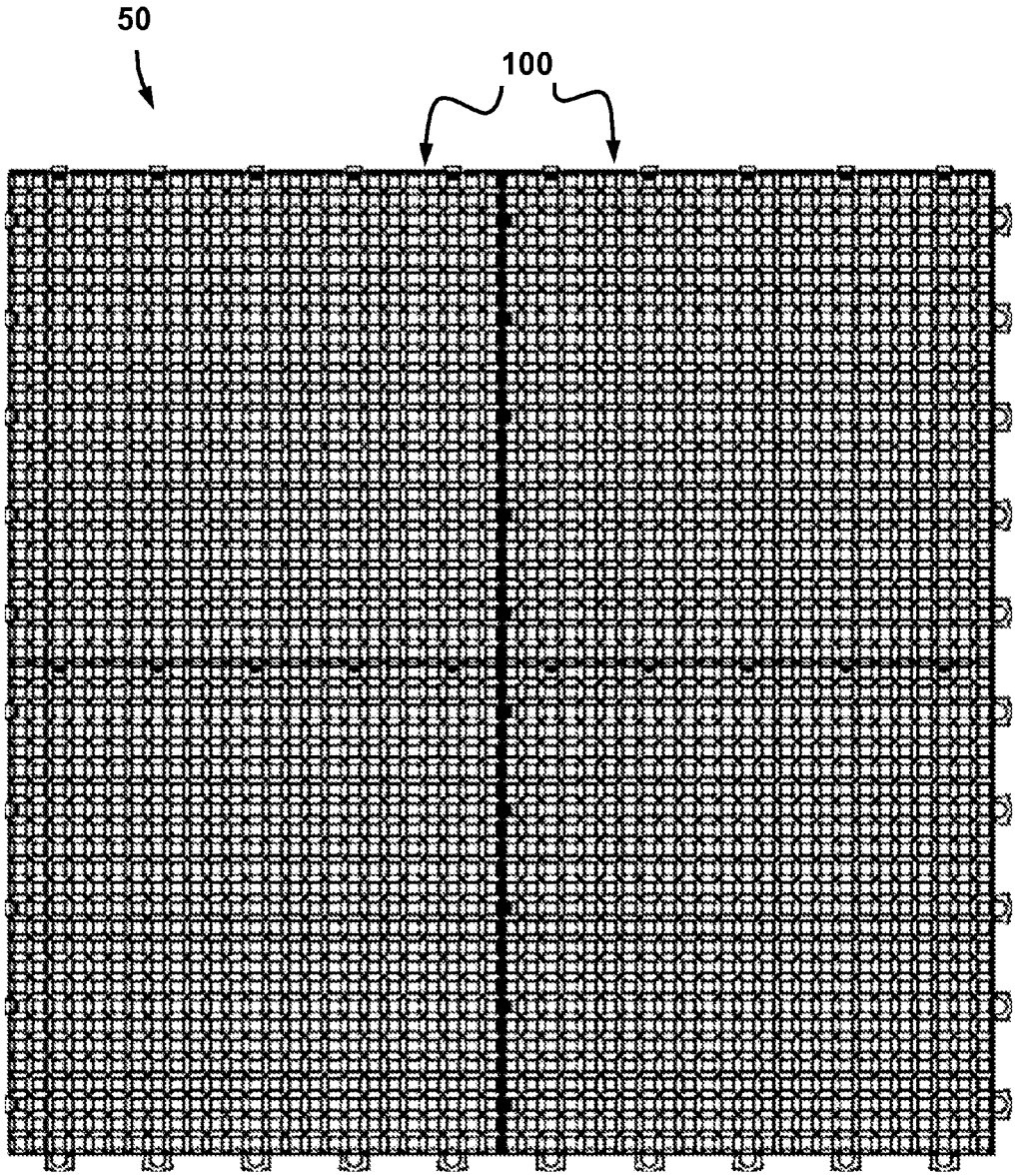
FIG. 1 is a top view of an example of a modular flooring system having a plurality of tiles incorporating the proposed concept.

FIG. 1 is a top view of an example of a modular flooring system 50 having a plurality of tiles 100 incorporating the proposed concept. The tiles 100 are mutually adjoined in abutting lateral contact and are disposed in a coplanar manner over a ground surface so as to form a continuous and flat floor surface. Each tile 100 has a planar top surface that forms a part of the floor surface of the modular flooring system 50.

Only four tiles 100 are shown in FIG. 1 for the sake of illustration. A modular flooring system 50 designed to form a playing surface will generally have a very large number of these tiles 100. These numerous tiles are interlocked with one another.

The tiles 100 have matching connector portions and adjacent tiles are connected side-by-side. The tiles 100 are all identical in the illustrated example. This facilitates manufacturing, handling and assembling. The size of the tiles 100 is also approximately 10 inches (25 cm) on each side. Nevertheless, it is possible to design the modular flooring system 50 with other dimensions and/or with more than one model of tiles 100.

The tiles 100 are only resting by gravity and are not directly fastened to the ground surface, for instance using screws or the like, since this is generally not necessary. The tiles 100 also have more freedom for compensating the thermal expansion when they are not directly fastened to the ground surface. The friction with the ground prevents the modular flooring system 50 from moving. Nevertheless, variants are possible.

Figure 2:
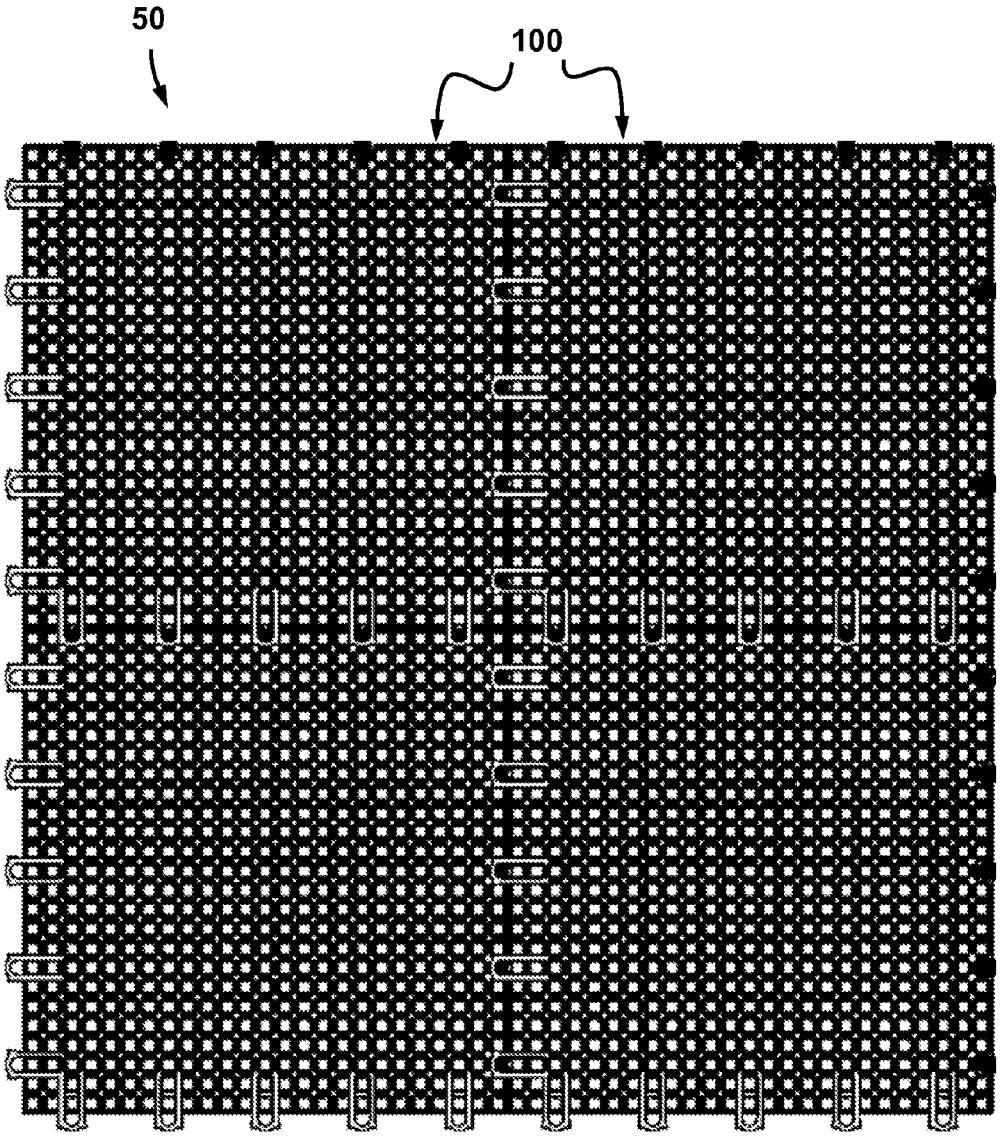
FIG. 2 is a bottom view of the modular flooring system shown in FIG. 1.

FIG. 2 is a bottom view of the modular flooring system 50 shown in FIG. 1. As can be seen, the adjacent tiles 100 have a plurality of spaced-apart connector portions between them that are located on the underside of the tiles 100. Since the tiles 100 are interconnected to one another, they form a structure where each tile 100 holds the corresponding bordering tiles 100.

Figure 3:
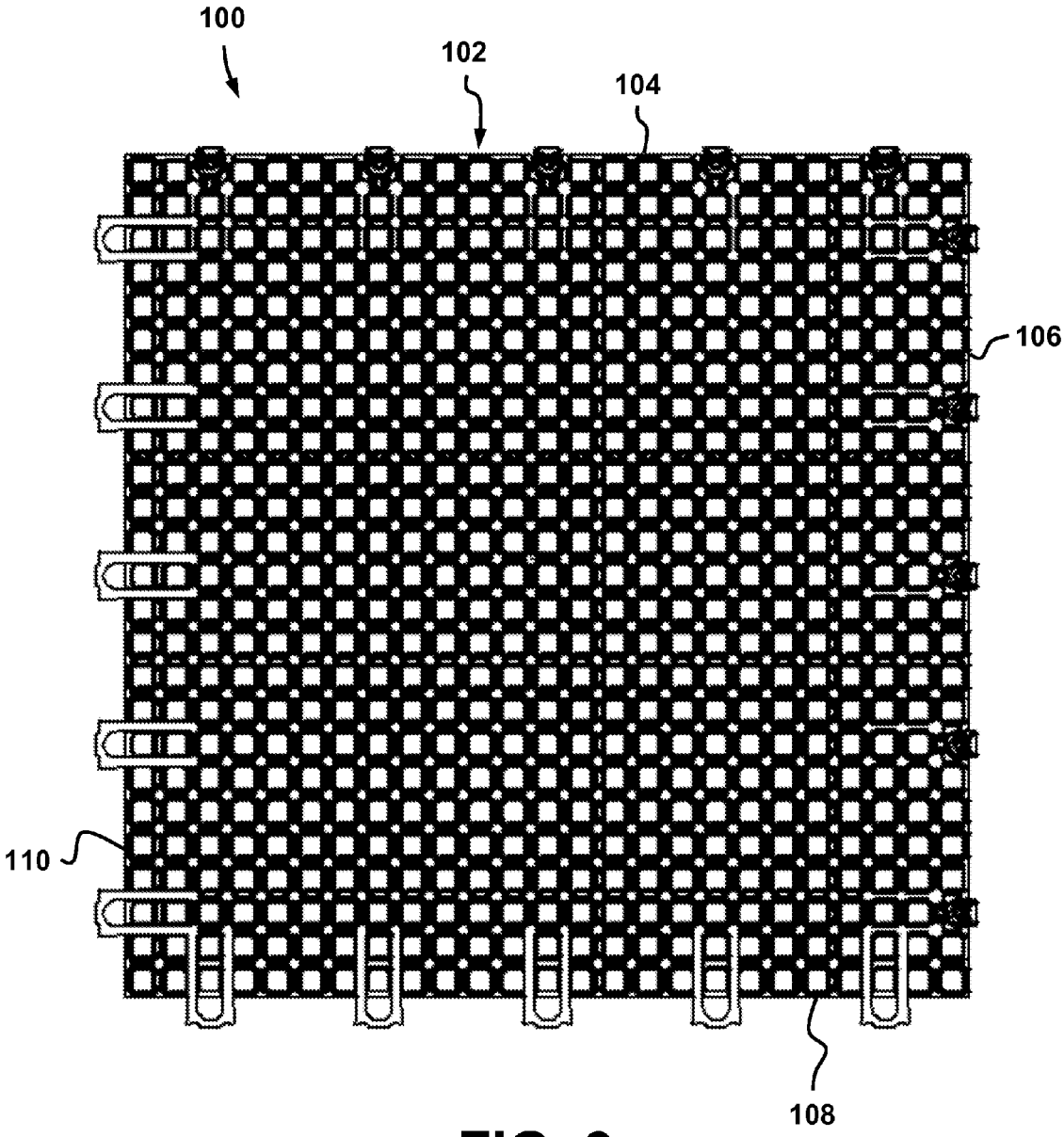
FIG. 3 is a bottom view of one of the tiles shown in FIGS. 1 and 2.

FIG. 3 is a bottom view of one of the tiles 100 shown in FIGS. 1 and 2. As in FIG. 2, the tile 100 in FIG. 3 is viewed from the bottom.

Figure 4:
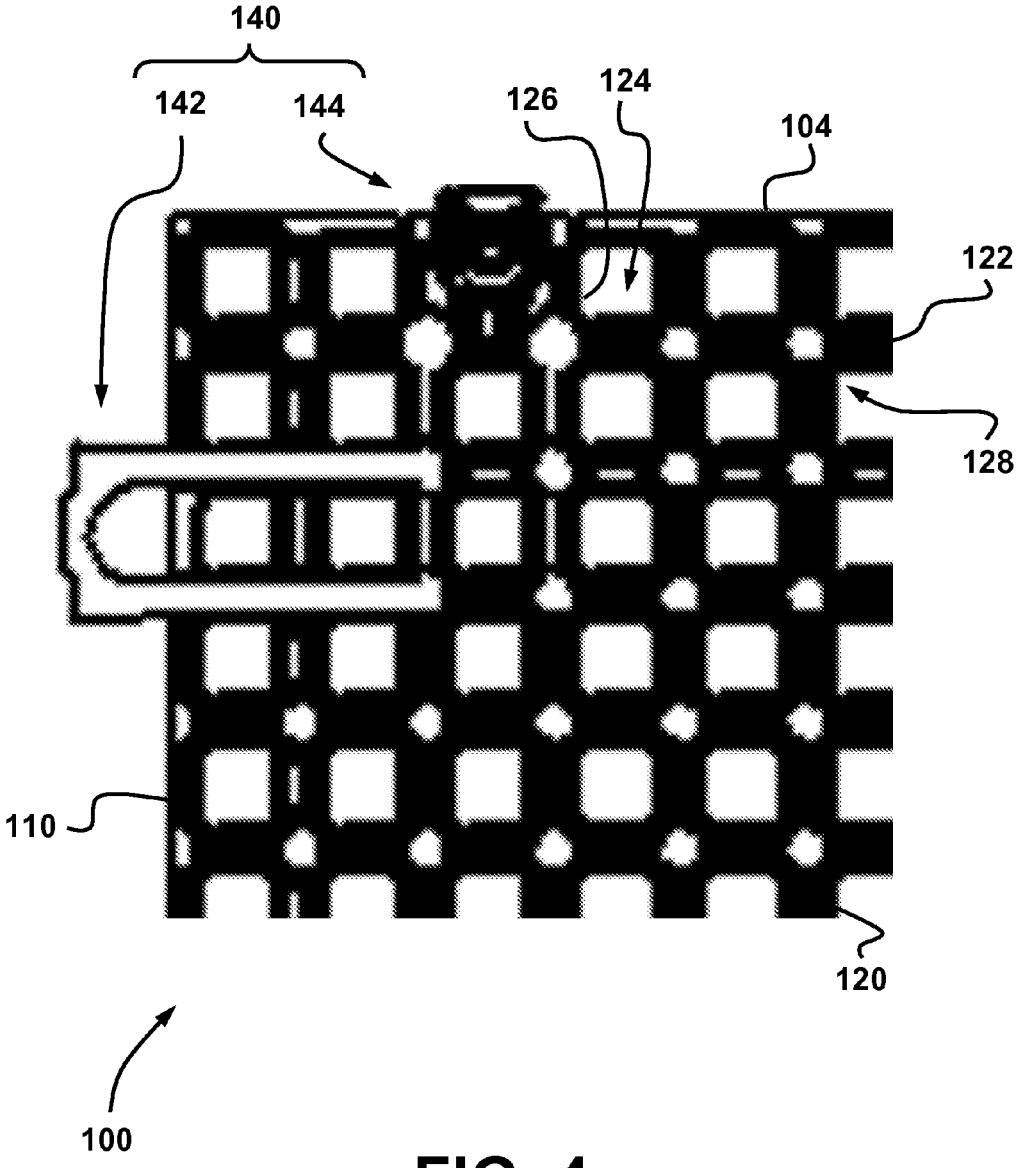
FIG. 4 is an enlarged view of the upper left corner of the tile as shown in FIG. 3.

FIG. 4 is an enlarged view of the upper left corner of the tile 100 as shown in FIG. 3.

The tile 100 includes a monolithic support grid structure 102 having a rectangular configuration with four peripheral edges 104, 106, 108, 110. The peripheral edges 104, 106, 108, 110 of the illustrated tile 100 have substantially the same length and are rectilinear. The tile 100 has a square shape and the side contact surfaces are planar. Variants are possible as well.

The support grid structure 102 includes a lattice framework of elongated rib members 120, 122 crisscrossing at right angle. The bottom side of the lattice framework forms the underside of the tile 100 and in the illustrated example, the top side of the lattice framework forms the top side of the tile 100. The first set of elongated rib members 120 extend in a first direction and the second set of elongated rib members 122 extend in a second direction. The first elongated rib members 120 are spaced-apart and parallel to one another. Likewise, the second elongated rib members 122 are spaced-apart and parallel to one another. This configuration defines a network of cells 124, each cell 124 having an interstitial opening 126 therein (FIG. 4). The elongated rib members 120, 122 of the illustrated example, in each direction, are regularly spaced from one another and the interstitial openings 126 have a substantially square-shape cross section defined by the inner face of the corresponding elongated rib members 120, 122. The various elongated rib members 120, 122 form intersections 128 where they cross. Other implementations may be designed differently, for instance with the rib member spacing in one direction being different from the rib member spacing in the perpendicular direction. Other variants are also possible.

In the illustrated example, the top surface of the tile 100 includes openings 112 (FIG. 7) that are made in registry with corresponding interstitial openings 126. The top surface of the tile 100 is still considered to be flat since these openings 112 are surrounded by substantially flat parts. The openings 112 on the top surface are somewhat smaller in width than the width of the interstitial openings 126 due to small flanges projecting inwardly. The openings 112 are substantially square shaped in this implementation. Variants are possible as well. For instance, some implementations may include a top surface devoid of openings such as a solid panel located over the support grid structure 102. The top surface of the tile 100 may also be formed by a second grid structure of crisscrossing elongated rib members and located over the support grid structure 102. Other kinds of top surfaces are also possible.

It should be noted that the radius of curvature of the material at the various corners is designed to be relatively large so as to mitigate the effects of local stress concentrations when loads are applied. This mitigates the risks of failures.

Figure 5:
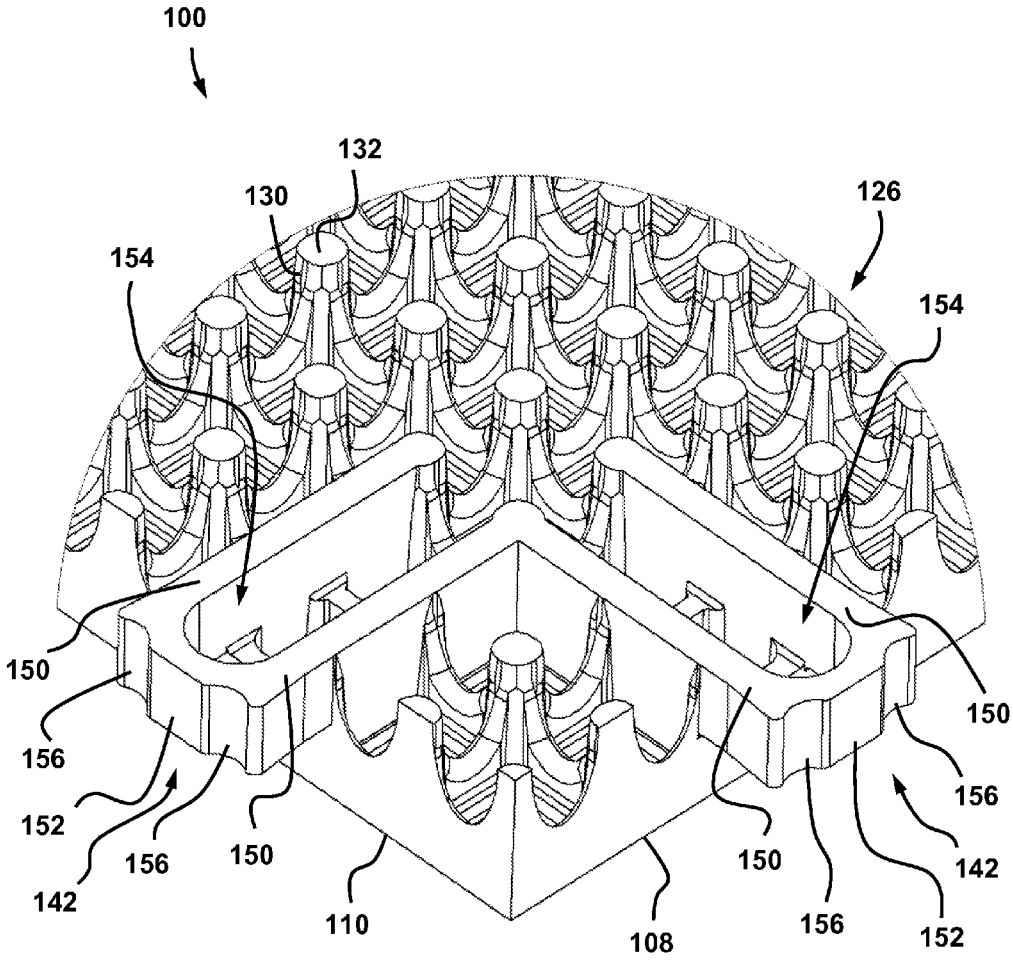
FIG. 5 is an isometric view of the bottom left corner of the tile as shown in FIG. 3.
Figure 6:
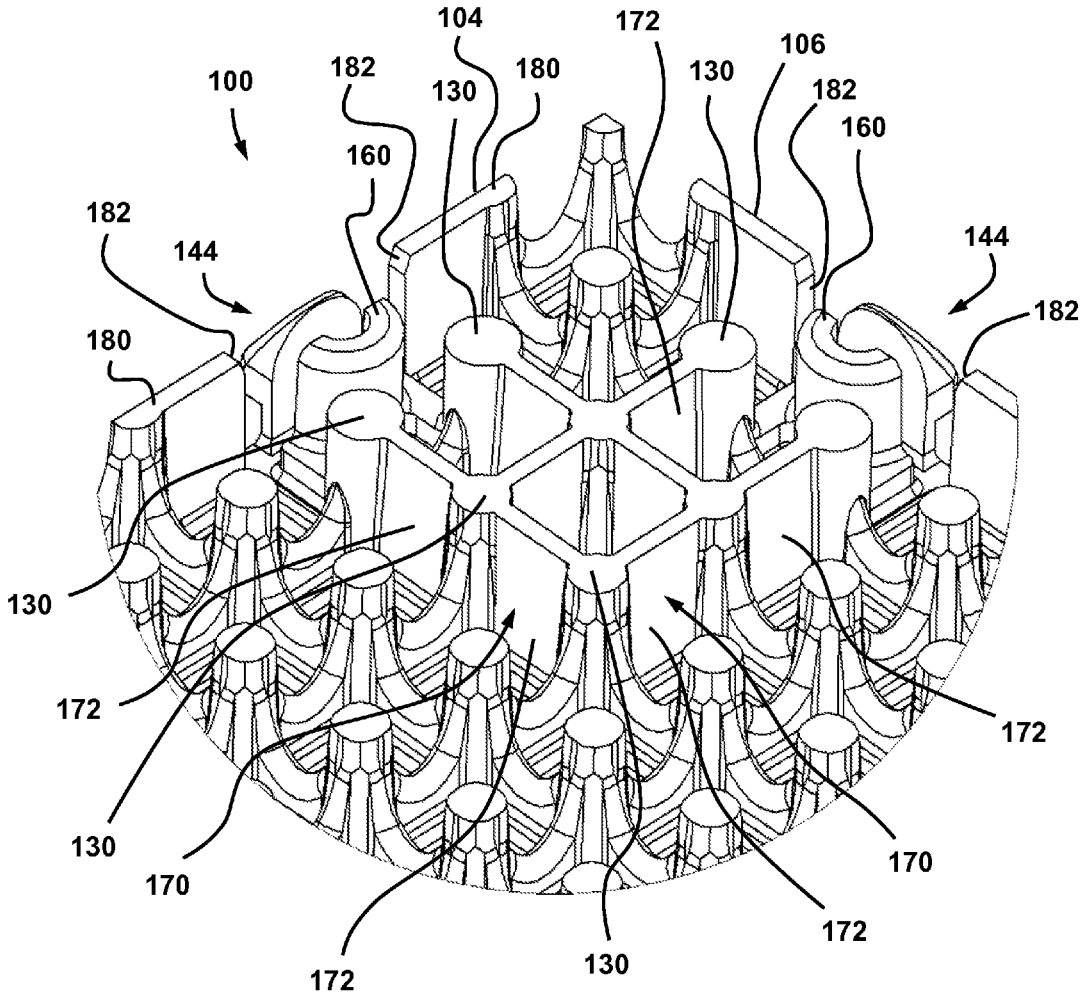
FIG. 6 is an isometric view of the upper right corner of the tile as shown in FIG. 3.

FIG. 5 is an isometric view of the bottom left corner of the tile 100 shown in FIG. 3. FIG. 6 is an isometric view of the upper right corner of the tile 100 as shown in FIG. 3.

As can be seen for instance in FIG. 5, the support grid structure 102 includes a plurality of spaced-apart support members 130 that are each downwardly projecting from a corresponding one of the intersections 128. The support members 130 have a substantially circular cross section in the illustrated example. However, other shapes are possible as well. There are support members 130 at almost all of the intersections 128 in the illustrated example. Variants are possible as well.

Each support member 130 has a ground-engaging distal end with a tip 132 that is coincident with a common bottom plane. This common bottom plane is substantially parallel to the planar top surface. The tip 132 of each support member 130 has a planar surface in the illustrated example.

In use, the tile 100 will be set over the ground surface with the underside facing downwards and the tips 132 will then engage the ground surface. The support members 130 will maintain the spacing between the ground surface and the lattice framework. Air and liquids, if any, will be able to flow between the ground surface and the lattice framework.

The bottom side of the elongated rib members 120, 122 of the illustrated example is curved where they merge with the support members 130 below the intersections 128, thereby forming arches, as shown for instance in FIG. 5. Variants are also possible.

The tile 100 further includes a plurality of tile edge connectors 140 (FIG. 4) that are positioned on the underside and that are made integral with the support grid structure 102. The tile edge connectors 140 will provide the removable connection to adjoin adjacent tiles with one another when the modular flooring system 50 is assembled. Each tile edge connector 140 is formed by a first connector portion 142 and by a complementary second connector portion 144 provided on an adjacent one of the tiles 100 in the modular flooring system 50. The illustrated tile 100 includes both first connector portions 142 and second connector portions 144 that are disposed in matching sets along corresponding ones of its peripheral edges 104, 106, 108, 110. Two juxtaposed peripheral edges 108, 110 have sets of spaced-apart first connector portions 142 and the other two juxtaposed peripheral edges 104, 108 have sets of spaced-apart second connector portions 144. This layout only requires one tile model to construct a rectangular-shaped modular flooring system. If desired, additional tile models can be made available to end users for providing more options, for instance for alternate shapes of the outer perimeter of the modular flooring system, including sections having a curved outer periphery. Tiles with a curved section can be convenient if the modular flooring system 50 is installed inside an arena or the like having boards that are curved near the opposite ends of the playing surface. Other variants are also possible.

Each first connector portion 142 of the tile 100 includes two spaced-apart and parallel side walls 150 downwardly projecting from two corresponding ones of the elongated rib members 120, 122 over at least two cells long. In the illustrated example, the side walls 150 replace the support members 130 at the corresponding intersections 128 and have a planar bottom surface that is substantially coincident with the common bottom plane, thus with the tips 132 of the support members 130. These bottom surfaces will thus engage the ground surface. The side walls 150 are straight and have a relatively wide rectangular-shaped cross section for added strength. Variants are possible as well.

The free ends of the side walls 150 extend beyond the corresponding peripheral edges 108, 110. They are also connected together by a transversal end wall 152, for instance an end wall 152 having a similar construction (e.g. width and height) than that of the side walls 150 as shown in the illustrated example. The two side walls 150 and the transversal end wall 152 form a monolithic and substantially U-shaped part.

The transversal end wall 152 includes an inner face and an outer face. The inner face defines, with inner faces of the side walls 150, an open space 154 located beyond the corresponding peripheral edge 108, 110. Also, the inner face of the transversal end wall 152 has a locking element, for instance a notch, a hole, a tooth or the like, that provides a resting point for a cooperating part, as explained later. The outer face of the transversal end wall 152 of the illustrated example includes two spaced-apart semi-circular outer recesses 156 extending along the height of the transversal end wall 152. The inner face of the transversal end wall 152 is also semi-circular in shape.

Figure 7:
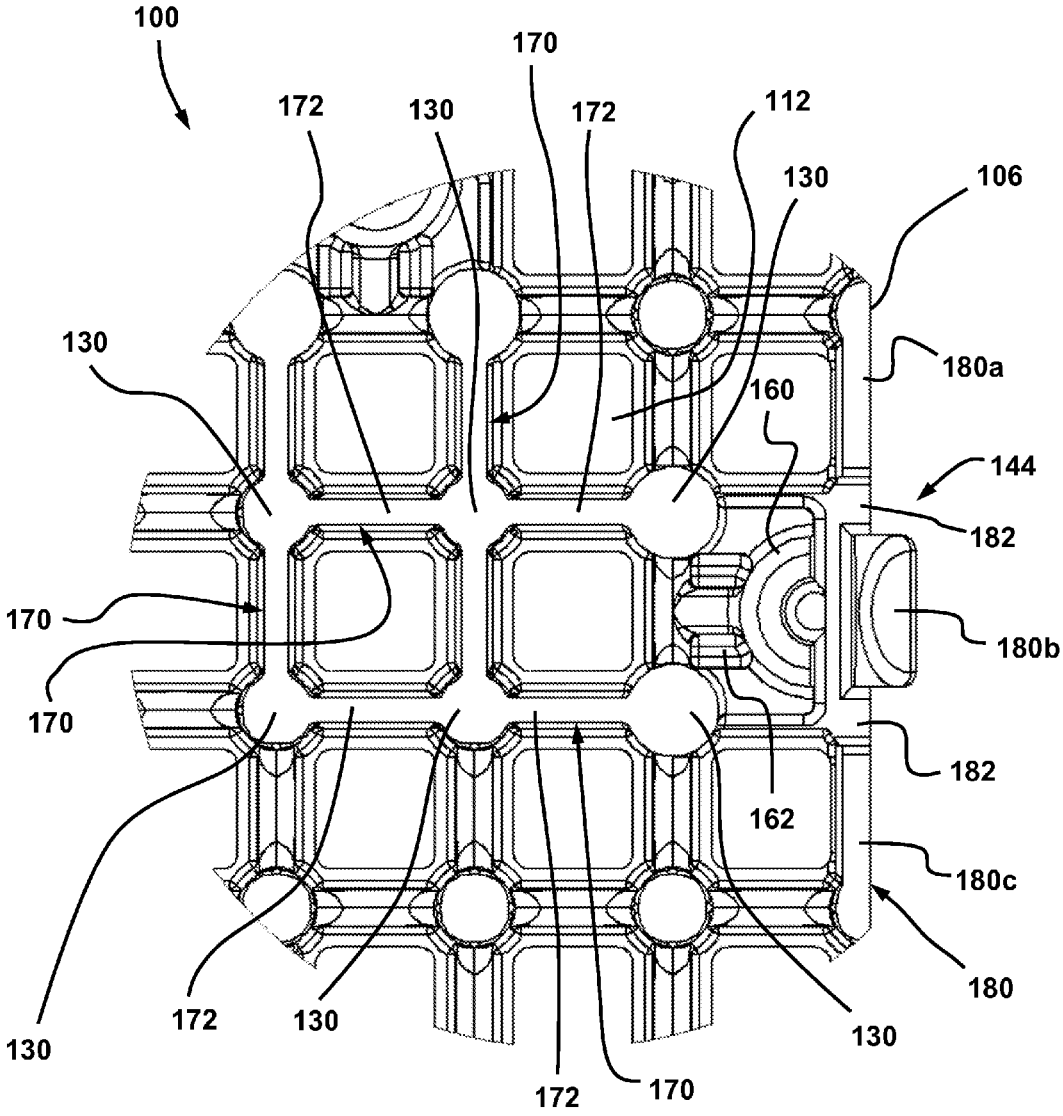
FIG. 7 is a bottom view of one of the snap-fit members of the tile shown in FIG. 3.

The second connector portions 144 are configured and disposed to cooperate with the first connector portions 142 provided on another one of the tile 100. Each second connector portion 144 includes a snap-fit member 160 downwardly projecting from a corresponding one of the cells 124, as shown for instance in FIGS. 6 and 7. FIG. 6 is an isometric view of the upper right corner of the tile 100 as shown in FIG. 3. FIG. 7 is a bottom view of one of the snap-fit members 160 of the tile 100 shown in FIG. 3, more particularly the snap-fit members 160 shown at the right in FIG. 6.

In the illustrated example, since the first connector portions 142 extend beyond the corresponding peripheral edges 108, 110 over about one cell long, each snap-fit member 160 is positioned about the center of the corresponding cell 124 that is immediately adjacent to the corresponding peripheral edge 108, 110. Each snap-fit member 160 is designed to fit inside the open space 154 of the corresponding first connector portion 142 and it includes a locking element, such as a hole, a notch, a tooth or the like, cooperating with the opposite locking element on the inner face of the transversal end wall 152. Both locking elements are opposite to one another so as to create a locking engagement. Nevertheless, some implementations may omit this feature. The snap-fit member 160 has a semi-circular cross section. Variants are possible as well.

As shown in FIG. 7, each snap-fit member 160 has a reinforced base 162 located near the elongated rib members 120, 122 and projects downwards. The snap-fit member 160 is designed to be resiliently flexible, thereby allowing the tip of the snap-fit member 160 to be slightly deflected sideways so as to interlock with the first connector portion 142 when they are brought together. The flexibility also creates a residual return force holding the locking elements together with an interfering engagement. The interfering engagement is removable but only if the tiles 100 are first lifted by hand off the ground surface. The snap-fit member 160 can be made more or less difficult to remove out of the first connector portion 142, depending on the design requirements.

As can be seen, the peripheral edges 104, 106, 108, 110 of the illustrated tile 100 are designed as if the corresponding elongated rib members 120, 122 and the corresponding support members 130 are cut in half. They will substantially match an opposite half that is provided on an adjacent one of the tiles 100. Together, the two halves of bordering tiles 100 (FIGS. 1 and 2) will be almost equivalent to one. The outer lateral surface of the peripheral edges 104, 106, 108, 110 create side contact surfaces that are planar and continuous. Variants are possible as well.

Each of the second connector portions 144 also includes a pair of spaced-apart and parallel reinforced wall sections 170. Each section 170 is provided on the underside of the tile 100 and downwardly projects from a corresponding one of the elongated rib members 120, 122 over at least two cells long. These straight wall sections 170 redistribute the lateral forces over more than the two cells 124. Each section 170 is in alignment with a corresponding one of the side walls 150 of the first connector portion 142 once the tile edge connector 140 is formed between the two adjacent ones of the tiles 100. In the illustrated example, the wall sections 170 are formed by the support members 130 and an intervening wall 172 between each two adjacent support members 130. Each intervening wall 172 extends over the entire length between two corresponding support members 130 and have a height matching that if the support members 130. Their bottom surface will thus engage the ground surface. Still, in the illustrated example, the support members 130 that are immediately adjacent to the corresponding snap-fit member 160 has a larger cross section than that of most support members 130 found elsewhere under the tile 100. Variants are possible as well.

As best shown in FIG. 6, the reinforced wall sections 170 at the common corner of the peripheral edge 104 and 106 are overlapping with one another in the illustrated example.

Also, as best shown in FIG. 5, the two peripheral edges 108, 110 with the first connector portions 142 have a common corner where the two side walls 150 of the first connector portions 142 that are the closest to the common corner are abutting one another.

Still, as can be seen in various figures, each peripheral edge 108, 110 with the first connector portions 142 has a common corner with a corresponding one of the peripheral edges 104, 106 with the second connector portions 144. The inner end of the side walls 150 of the corresponding first connector portion 142 that is located on a respective side of the common corner is directly made integral with one of the reinforced wall sections 170 of the corresponding second connector portion 144.

Figure 8:
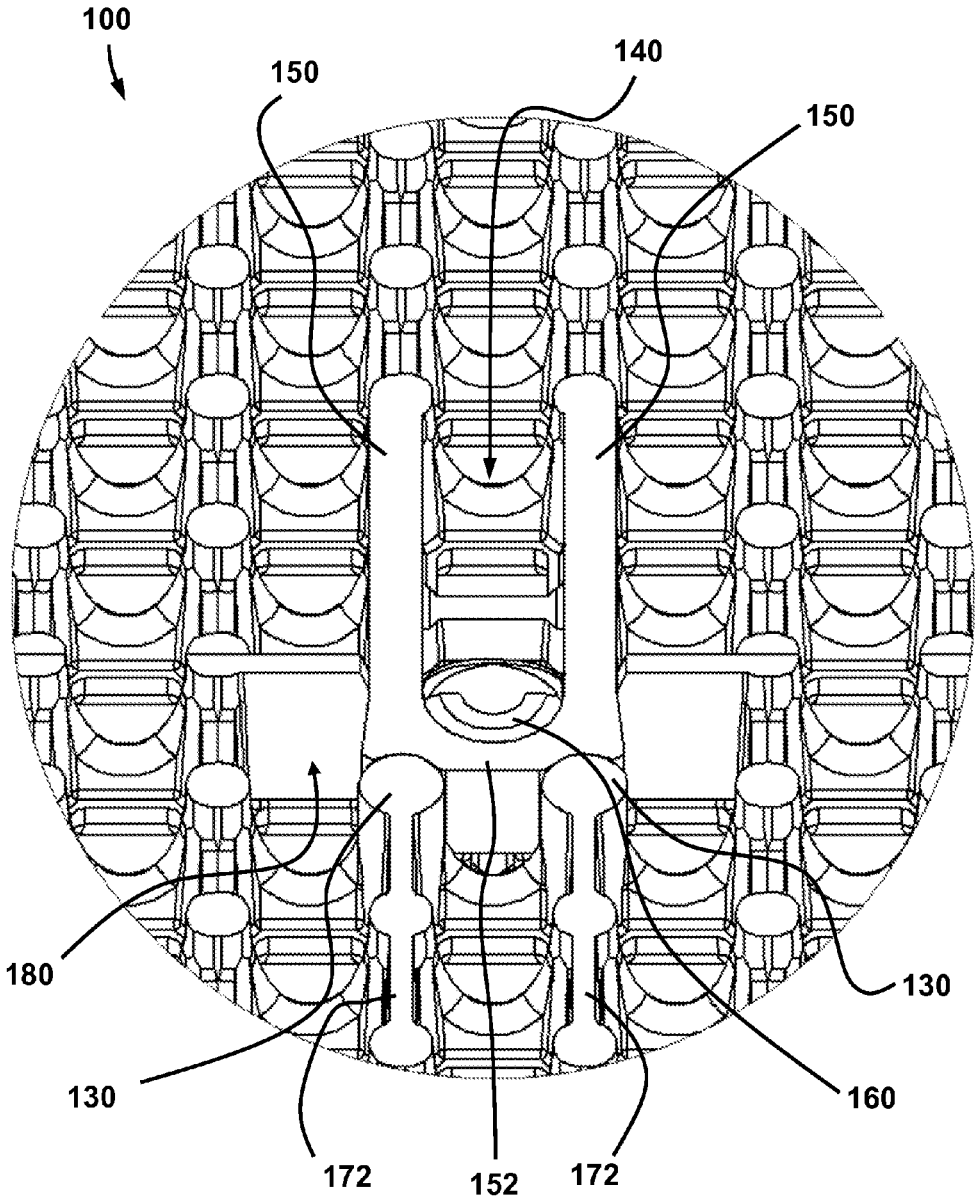
FIG. 8 is an isometric view of one of the tile edge connectors between two adjacent tiles shown in FIGS. 1 and 2.
Figure 9:
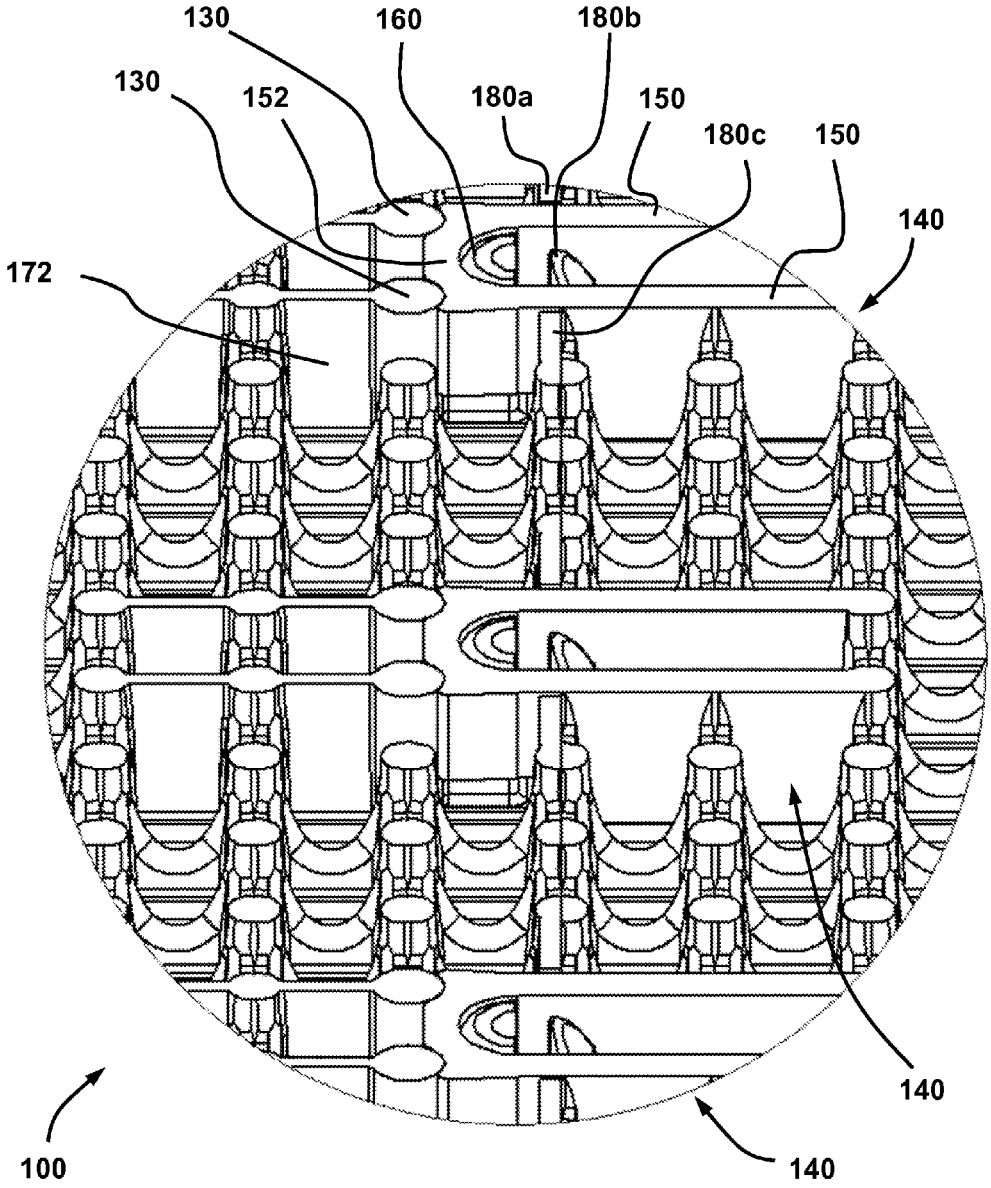
FIG. 9 is an isometric view illustrating, from another angle than that of FIG. 8, a plurality of tile edge connectors provided between two adjacent tiles shown in FIGS. 1 and 2.

Once the tile edge connectors 140 are assembled, the recesses 156 on the transversal end wall 152 of the first connector portion 142 are designed to be in abutting engagement with an outer lateral side of the corresponding wall sections 170. In the illustrated example, the outer lateral sides are formed by the enlarged support members 130 that are the closest to the corresponding snap-fit member 160. This is shown for instance in FIGS. 8 and 9. FIG. 8 is an isometric view of a tile edge connector 140 between two adjacent ones of the tiles 100 shown in FIGS. 1 and 2. FIG. 9 is an isometric view illustrating, from another angle than that of FIG. 8, a plurality of tile edge connectors 140 between two adjacent ones of the tiles 100 shown in FIGS. 1 and 2.

As best shown in FIG. 7, each snap-fit member 160 is positioned immediately behind a slotted wall 180 that is coincident with the corresponding peripheral edge 104, 106. The slotted wall 180 has two vertical slots 182 that divide the slotted wall 180 in three juxtaposed sections 180*a*, 180*b*, 180*c*. The snap-fit member 160 is adjacent to the central section 180*b*.

The slots 182 are located where the side walls 150 of the first connector portion 142 of the adjacent tile 100 cross the corresponding peripheral edge 104, 106 when the tile edge connector 140 is assembled, as shown for instance in FIGS. 8 and 9. The width of the slots 182 is chosen to match the width of the side walls 150, thereby providing a tight fit for mitigating lateral movements when the tiles 100 are subjected to lateral forces.

As can be appreciated, the tile edge connectors 140 of the tile 100 are designed in such manner that the lateral movements are very restricted and controlled from all sides because of the design. The forces are also well distributed over a wide area. The useful life of such tile 100 is thus increased since the design mitigates failures due to mechanical stresses and wear of the underside due to the friction. The tile 100 is less prone to wear since the relative movements between the tiles are very restricted. The ground surface itself is also less prone to wear, which is very desirable to mitigate undesirable accumulations of dust resulting from the erosion of the ground surface over which the tiles are set. Maintenance is simplified since less cleaning is required.

Still, the tile 100 simplifies the installation of the modular flooring system 50 since they can be set directly over the ground surface without an intervening layer, such as a rubber mat or the like in most implementations. This simplifies installation and lowers the costs.

The tile 100 can be made of a material such as a plastic material. Other materials are also possible, for instance, the materials are not limited to plastics. These other materials can be metals and composite materials, to name just a few examples.

Depending on the implementation, the material can be relatively rigid or not. For instance, if the tile 100 is for use in a modular flooring system intended for in-line skating, the material will be relatively rigid. Others can be made of an impact-absorbing material that is relatively resilient.

The tile 100 can be manufactured using an injection process, for instance a thermoplastic injection process, where the entire tile is molded in a monolithic piece. All parts are then integrally formed and the tiles 100 can be mass-produced at a relatively low cost. Still, other manufacturing processes can be used if desired.

The present detailed description and the appended figures are meant to be exemplary only, and a skilled person will recognize that variants can be made in light of a review of the present disclosure without departing from the proposed concept.

LIST OF REFERENCE NUMERALS

50 modular flooring system
100 tile
102 support grid structure
104 peripheral edge
106 peripheral edge
108 peripheral edge
110 peripheral edge
112 opening (top surface)
120 elongated rib member (first direction)
122 elongated rib member (second direction)
124 cell
126 interstitial opening
128 intersection
130 support member
132 tip
140 tile edge connector
142 first connector portion
144 second connector portion
150 side wall (first connector portion)
152 end wall (first connector portion)
154 open space
156 recess (on the end wall)
160 snap-fit member
162 base (of snap-fit member)
170 reinforced wall member
172 intervening wall
180 slotted wall
180*a* slotted wall section
180*b* slotted wall section
180*c* slotted wall section
182 slot

What is claimed is:

1. A tile for use in a modular flooring system having a plurality of such tile that are mutually adjoined in abutting lateral contact and that are disposed in a coplanar manner over a ground surface so as to form a continuous and flat floor surface, the tile having a planar top surface and an underside, the tile including:

a monolithic support grid structure having a rectangular configuration with four peripheral edges, the support grid structure including:

a lattice framework of elongated rib members crisscrossing at right angle on the underside of the support grid structure and defining a network of cells;

a plurality of support members, each downwardly projecting from a corresponding intersection between at least some of the crisscrossing elongated rib members and having a ground-engaging distal end with a tip that is coincident with a common bottom plane, which common bottom plane is substantially parallel to the planar top surface; and a plurality of first and second connector portions that are positioned on the underside and made integral with the support grid structure, the first connector portions and the second connector portions being both present on the tile and disposed in matching sets along corresponding ones of the peripheral edges of the tile, wherein:

each first connector portion includes two spaced-apart and parallel side walls downwardly projecting from two corresponding ones of the elongated rib members over at least two cells long, the side walls having free ends extending beyond the corresponding peripheral edge and that are connected together by a transversal end wall, the transversal end wall including an inner face defining, with inner faces of the side walls, an open space located beyond the corresponding peripheral edge; and each second connector portion includes a snap-fit member downwardly projecting from a corresponding one of the cells and also includes a pair of spaced-apart and parallel reinforced wall sections, each section being provided on the underside and downwardly projecting from a corresponding one of the elongated rib members over at least two cells long, each reinforced wall section being in alignment with a corresponding one of the side walls of the first connector portion of an adjacent tile when two tiles are connected.

2. The tile as defined in claim 1, wherein each second connector portion further includes a transversal wall that is coincident with the corresponding peripheral edge, the transversal wall having two spaced-apart slots that are in registry with the corresponding reinforced wall sections.

3. The tile as defined in claim 1, wherein the inner face of the end wall of the first connector portions has a locking element cooperating with an opposite locking element on a corresponding one among the snap-fit members.

4. The tile as defined in claim 1, wherein the first connector portions are positioned next to two of the four peripheral edges and the second connector portions are positioned next to the other two of the four peripheral edges.

5. The tile as defined in claim 4, wherein the two peripheral edges with the first connector portions are juxtaposed to one another and the two peripheral edges with the second connector portions are juxtaposed to one another.

6. The tile as defined in claim 5, wherein the two peripheral edges with the first connector portions have a common corner, two of the side walls of the first connector portions being located on a respective side of the common corner and abutting one another.

7. The tile as defined in claim 5, wherein the two peripheral edges with the second connector portions have a common corner, the reinforced wall sections of the two second connector portions that are located adjacent to the common corner intersecting one another.

8. The tile as defined in claim 5, wherein each peripheral edge with the first connector portions has a common corner with a corresponding one of the peripheral edges with the second connector portions, the side walls of the corresponding first connector portion that is located on a respective side of the common corner being directly made integral with one of the reinforced wall sections of the corresponding second connector portion.

9. The tile as defined in claim 5, wherein each peripheral edge has a planar side contact surface and all four peripheral edges have substantially an identical length.

10. The tile as defined in claim 1, wherein the first connector portions have a bottom surface that is substantially coincident with the common bottom plane.

11. The tile as defined in claim 1, wherein the top surface of the tile includes a plurality of openings communicating with the underside, which openings are in registry with interstitial openings formed on the underside of the tile.

12. The tile as defined in claim 11, wherein the openings on the top surface are square shaped and include rounded corner to mitigate stress concentrations.

13. The tile as defined in claim 1, wherein the top surface of the tile is devoid of openings.

14. The tile as defined in claim 1, wherein each reinforced wall section includes corresponding ones of the support members between which intervening walls are provided.

15. The tile as defined in claim 14, wherein in each reinforced wall section, the support members that are closer to the corresponding snap-fit member have a larger cross section than the other support members on the reinforced wall section.

16. The tile as defined in claim 15, wherein the transversal end wall of the first connector portions includes an outer face provided with spaced-apart outer recesses that are in abutting engagement with an outer lateral side of the reinforced wall sections when two tiles are connected.

17. The tile as defined in claim 1, wherein each support member and the corresponding elongated rib members form arches where they merge.

18. The tile as defined in claim 1, wherein each of the snap-fit members is positioned about a center of the corresponding cell that is immediately adjacent to the corresponding peripheral edge.

19. The tile as defined in claim 1, wherein the support grid structure and the first and second connector portions are made of a plastic material.

20. The tile as defined in claim 1, wherein the modular flooring system in which the tile is used has numerous identical tiles that are interlocked with the tile to form a rigid in-line skating playing surface.

* * * * *